United States Patent [19]

Young et al.

[11] Patent Number: 4,475,346

[45] Date of Patent: Oct. 9, 1984

[54] REFRIGERATION SYSTEM WITH LINEAR MOTOR TRIMMING OF DISPLACER MOVEMENT

[75] Inventors: Neils O. Young, Free Union, Va.; Robert Henderson, Reading; Peter J. Kerney, Arlington, both of Mass.

[73] Assignee: Helix Technology Corporation, Waltham, Mass.

[21] Appl. No.: 447,192

[22] Filed: Dec. 6, 1982

[51] Int. Cl.[3] ..... F25B 9/00

[52] U.S. Cl. ..... 62/6; 60/520

[58] Field of Search ..... 62/6; 60/517, 520

[56] References Cited

U.S. PATENT DOCUMENTS 3,220,201 11/1965 Heuchling et al. ..... 62/3
3,991,586 11/1976 Acord ..... 62/6
4,389,850 6/1983 Sarcia ..... 62/6

*Primary Examiner*—Ronald C. Capossela
*Attorney, Agent, or Firm*—Hamilton, Brook, Smith & Reynolds

[57] ABSTRACT

A split Stirling refrigerator includes a pneumatically driven displacer, the displacer is driven substantially through an entire stroke by the pressure differential across a piston element extending from the displacer. A small linear trimming motor is provided to assure proper phasing of the displacer movement with the refrigerator pressure wave, to prevent overstroke, and to assure complete stroke of the displacer.

9 Claims, 11 Drawing Figures

REFRIGERATION SYSTEM WITH LINEAR MOTOR TRIMMING OF DISPLACER MOVEMENT

DESCRIPTION

1. Field of the Invention

This invention relates to refrigeration systems which include reciprocating displacers such as split Stirling cryogenic refrigerators.

2. Background

A conventional split Stirling refrigeration system is shown in FIGS. 1–4. This system includes a reciprocating compressor 14 and a cold finger 16. The piston 17 of the compressor provides a nearly sinusoidal pressure variation in a pressurized refrigeration gas such as helium. The pressure variation in a head space 18 is transmitted through a supply line 20 to the cold finger 16.

The usual split Stirling system includes an electric motor driven compressor. A modification of that system is the split Vuilleumier. In that system a thermal compressor is used. This invention is applicable to both of those refrigerators as well as others.

Within the housing of the cold finger 16 a cylindrical displacer 26 is free to move in a reciprocating motion to change the volumes of a warm space 22 and a cold space 24 within the cold finger. The displacer 26 contains a regenerative heat exchanger 28 comprised of several hundred fine-mesh metal screen discs stacked to form a cylindrical matrix. Other regenerators, such as those with stacked balls, are also known. Helium is free to flow through the regenerator between the warm space 22 and the cold space 24. As will be discussed below, a piston element 30 extends upwardly from the main body of the displacer 26 into a gas spring volume 32 at the warm end of the cold finger.

The refrigeration system of FIGS. 1–4 can be seen as including two isolated volumes of pressurized gas. A working volume of gas comprises the gas in the space 18 at the end of the compressor, the gas in the supply line 20, and the gas in the spaces 22 and 24 and in the regenerator 28 of the cold finger 16. The second volume of gas is the gas spring volume 32 which is sealed from the working volume by a piston seal 34 surrounding the drive piston 30.

Operation of the conventional split Stirling refrigeration system will now be described. At the point in the cycle shown in FIG. 1, the displacer 26 is at the cold end of the cold finger 16 and the compressor is compressing the gas in the working volume. This compressing movement of the compressor piston 17 causes the pressure in the working volume to rise from a minimum pressure to a maximum pressure and this warms the working volume of gas. The pressure in the gas spring volume 32 is stabilized at a level between the minimum and maximum pressure levels of the working volume. Thus, at some point the increasing pressure in the working volume creates a sufficient pressure difference across the drive piston 30 to overcome retarding forces, including a pressure differential across the displacer and the friction of displacer seal 36 and drive seal 34. The displacer then moves rapidly upward to the position of FIG. 2. With this movement of the displacer, high-pressure working gas at about ambient temperature is forced through the regenerator 28 into the cold space 24. The regenerator absorbs heat from the flowing pressurized gas and thereby reduces the temperature of the gas.

With the sinusoidal drive from a crank shaft mechanism, the compressor piston 17 now begins to expand the working volume as shown in FIG. 3. With expansion, the high pressure helium in the cold space 24 is cooled even further. It is this cooling in the cold space 24 which provides the refrigeration for maintaining a temperature gradient of over 200 degrees Kelvin over the length of the regenerator.

At some point in the expanding movement of the piston 17, the pressure in the working volume drops sufficiently below that in the gas spring volume 32 for the gas pressure differential across the piston portion 30 to overcome retarding forces such as seal friction. The displacer 26 is then driven downward to the position of FIG. 4, which is also the starting position of FIG. 1. The cooled gas in the cold space 24 is thus driven through the regenerator to extract heat from the regenerator.

It has been understood that the phase relationship between the working volume pressure and the displacer movement is dependent upon the braking force of the seals on the displacer. If those seals provided very low friction, it had been understood that the displacer would move from the lower position of FIG. 1 to the upper position of FIG. 2 soon after the working volume pressure increased past the pressure in the spring volume 32. Because the spring volume is at a pressure about midway between the minimum and the maximum values of the working volume pressure, movement of the displacer would take place during the midstroke of the compressor piston 17. This would result in compression of a substantial amount of gas in the cold end 24 of the cold finger, and because compression of gas warms that gas this would be an undesirable result.

To increase the efficiency of the system, upward movement of the displacer is retarded until the compressor piston 17 is near the end of a stroke as shown in FIGS. 1 and 2. In that way, substantially all of the gas is compressed and thus warmed in the warm end 22 of the cold finger, and that warmed gas is then merely displaced through the regenerator 28 as the displacer moves upward. Thus, the gas then contained in the large volume 24 at the cold end is as cold as possible before expansion for further cooling of that gas. Similarly, it is preferred that as much gas as possible be expanded in the cold end of the cold finger prior to being displaced by the displacer 26 to the warm end. Again, the movement of the displacer must be retarded relative to the pressure changes in the working volume.

In prior systems, the seals 34 and 36 are designed and fabricated to provide an amount of loading to the displacer to retard the displacer movement by an optimum amount. A major problem of split Stirling systems is that with wear of the seals the braking action of those seals varies. As the braking action becomes less the displacer movement is advanced in phase and the efficiency of the refrigerator is decreased. Also, braking action can be dependent on the direction of the pressure differential across the seal.

In addition to the problem of wear of the seals, the refrigerator is often subjected to different environments. For example, a refrigerator may be stored at extremely high temperature and be called on to provide efficient cryogenic refrigeration. On the other hand, the refrigerator may be subject to very cold environments. The sealing action and friction of the seals is generally very dependent on temperature.

Due to the problems associated with synchronizing the regenerator movement with the pressure waves from the compressor, efforts have been made to utilize linear drive motors rather than the pneumatic drive discussed above. An example of such a system can be found in U.S. Pat. No. 3,991,586 to Acord. That system also utilizes clearance seals and thus avoids the problems associated with wear of conventional seals. The problem associated with such a linear motor system is that the linear drive motor is bulky and heavy and generates heat at the cold finger portion of the refrigerator. In a split Stirling refrigerator, it is often critical that the cold finger portion of the refrigerator be minimized in size and weight and that little heat be generated in that portion of the system. It is for those reasons that the pneumatic drive has been so widely used in split Stirling systems.

DISCLOSURE OF THE INVENTION

A refrigerator has a gas displacer which reciprocates in a cold finger housing to displace gas in a working volume of gas through a regenerator. The fluid pressure in the working volume varies between maximum and minimum pressures. A spring volume of gas is provided, and a piston element extends axially from the displacer into the spring volume. The cross sectional area of the piston element is such that the pressure differential across the piston element, between the working volume and the spring volume, drives the displacer element through a substantially full stroke in each direction as in conventional pneumatically driven Stirling refrigerators. In accordance with the present invention, an electrically powered linear drive is provided to the displacer, but that drive only applies force to the displacer for trimming the movement of the displacer. Such trimming of the movement may include phase control to assure proper synchronization of the displacer movement with the compressor pressure wave, prevention of overstroke in which the displacer raps against one or both ends of the cold finger and assurance of full stroke which might be inhibited by seal friction or the like.

BRIEF DESCRIPTION OF THE DRAWINGS

The foregoing and other objects, features and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

DESCRIPTION OF A PREFERRED EMBODIMENT

Figure 5:
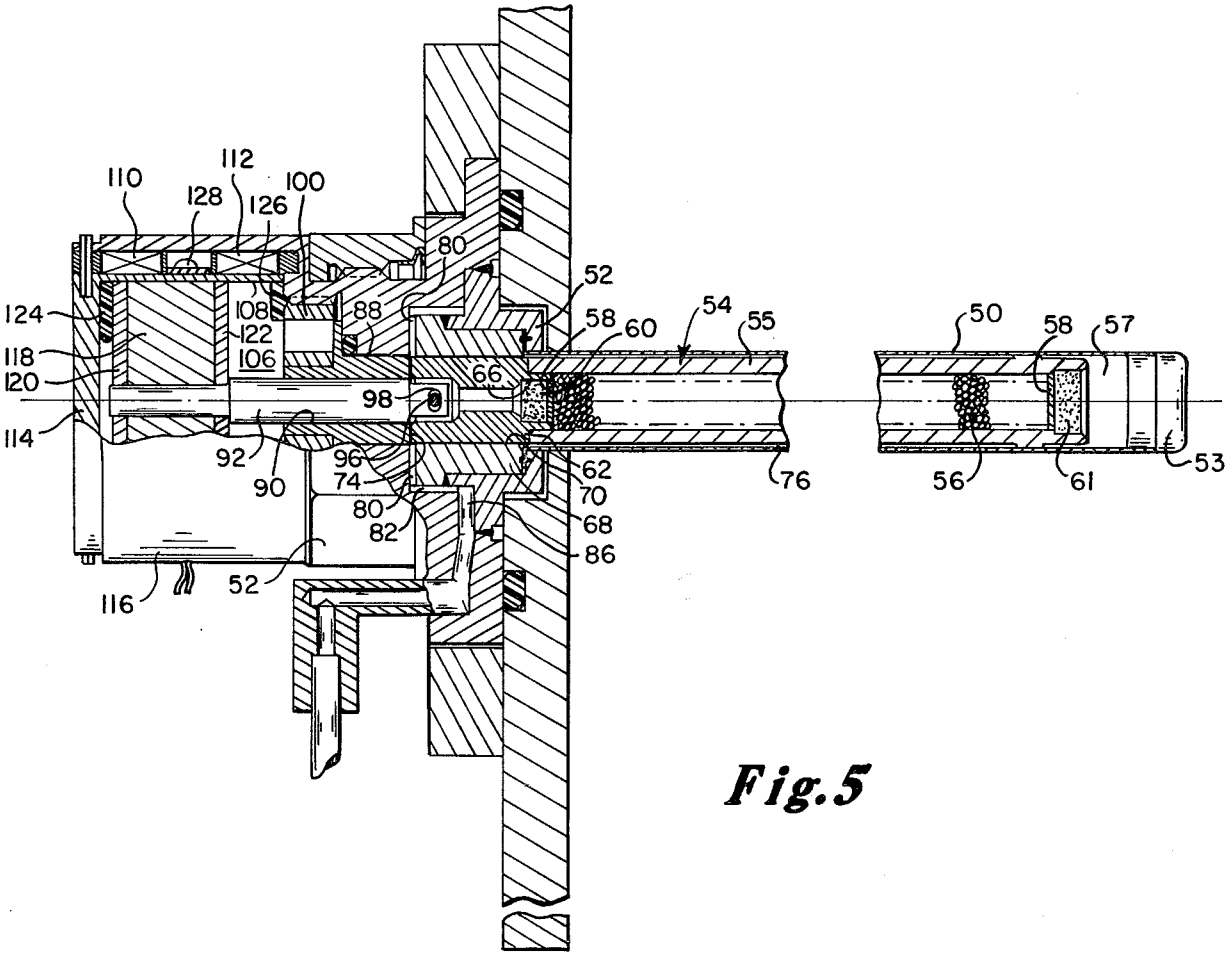
FIG. 5 is a longitudinal cross sectional view of the cold finger portion of a split Stirling refrigerator embodying the present invention.

The cold finger of the split Stirling refrigerator shown in FIG. 5 includes an outer cylindrical casing 50 fixed to and suspended from a cold finger head 52. The opposite, cold end of the cylinder 50 is closed by a heat exchanger cap 53. An infrared detecting device or the like may be mounted to that heat exchanger. A displacer 54, mounted for reciprocating movement within the cylinder 50, includes a fiberglass epoxy cylinder 55. The cylinder 55 is packed with nickel balls 56 sandwiched between short stacks of screen 58 at each end of the regenerator. The screen is held in place by porous plugs 60 and 61. The porous plug 60 is positioned at the end of a bore 66 in a cermet clearance seal element 62.

The cermet clearance seal element 62 is fixed to the cylinder 55 by epoxy. It is seated within a second cermet clearance seal element 68 to provide a clearance seal 70. A pressure equalization groove (not shown) may be provided in the first cermet element 62 to minimize pressure force differentials on the clearance seal element which might tend to bind the displacer. The clearance seal 70 is preferably a 0.00015 inch (0.0038 millimeter) gap between the two cermet clearance seal elements. The gap is half the diametrical clearance between the clearance seal elements. That clearance seal allows for virtually dragless movement of the element 62 within the element 68 while providing excellent sealing between the warm end 74 of the cold finger working volume and an annulus 76 between the cold finger cylinder 50 and the displacer cylinder 55. The sealing action of the clearance seal is due to the small gap along the approximately 0.25 inch (6 millimeter) length of the seal.

Channels 80 are formed in the top of the clearance seal element 68 to provide fluid communication between the warm end 74 of the displacer and an annulus 82. The annulus 82 is connected to a compressor (not shown) through a port 86.

Another outer clearance seal element 88 is positioned within the cold finger head 52. This element is also formed of cermet. The clearance seal element 88 has a smaller inner diameter than the element 68 in order to provide a clearance seal 90 with a cermet drive piston 92. The cermet piston 92, and thus the cermet of clearance seal element 88 are of nonmagnetic cermet material.

The clearance seal element 88 is clamped against the cold finger head 52 by a clamping nut 100.

The piston 92 reciprocates with the main body of the displacer, and in fact the pressure differential across the drive piston serves to drive the entire displacer. In order to ease tolerance requirements in forming the coaxial clearance seals 90 and 70, the piston 92 is joined to the cermet element 62 by means of a pin 96 extending through a transverse slot 98 at the lower end of the piston 92.

The spring volume 106 is defined in part by a nonmetallic ring 108 which supports two coils 110 and 112 of a linear drive motor. The ring 108 isolates the coils from the helium environment of the spring volume 106 to avoid contamination of the helium. The spring volume is completed by an end cap 114 joined to a cylindrical housing 116. A samarium cobalt magnet 118, sandwiched between iron flux return plates 120 and 122, is mounted to the drive piston 92. Elastomeric bumpers 124 and 126 are provided to stop overstroke of the magnet; however, overstroke is generally prevented by the linear drive motor as will be discussed below so the bumpers are not required.

A Hall effect position sensor 128 is provided to sense the location of the magnet 118 within the stroke of the magnet, the piston 92 and the displacer 54.

Other than the force applied by the linear drive motor, the primary forces applied to the piston 92 and displacer 55 which result in movement of those elements are the pressure of the spring volume 106 acting against the left end of the drive piston 92 as viewed in FIG. 5, the pressure in the working volume at the warm end 74 acting against the left end of the displacer, the working volume pressure at the cold volume 57 acting against the right end of the displacer, and friction forces. By the use of clearance seals rather than conventional friction seals, substantially all Coulomb friction forces have been eliminated.

Disregarding the forces applied by the linear motor, the force equation for the displacer and drive piston is:

$$F_{Total}=P_C A_C - P_W(A_C - A_S) - P_S A_S \pm f_{Coul} \quad (1)$$

where $P_C$, $P_W$ and $P_S$ are the fluid pressure at the cold end 57, at the warm end 74, and in the spring volume 106, respectively, $A_C$ and $A_S$ are the cross sectional areas of the regenerator cylinder 55 and the piston cylinder 92, respectively, and $f_{Coul}$ is the Coulomb friction which resists movement of the displacer/piston assembly.

By defining a term $\delta$ as the pressure drop across the displacer between the warm and cold ends of the displacer, the cold end pressure term of equation 1 can be replaced as follows:

$$P_C = P_W - \delta \text{ when } P_W \text{ is increasing}$$

$$P_C = P_W + \delta \text{ when } P_W \text{ is decreasing} \quad (2)$$

Substituting for $P_C$ gives:

$$F_{Total} = (P_W \pm \delta)A_C - P_W(A_C - A_S) - P_S A_S \pm f_{Coul} \quad (3)$$

$$= P_W(A_S) - P_S A_S \pm \delta A_C \pm f_{Coul}$$

Further, the total force on the displacer at the instant just prior to movement of the displacer is equal to zero. Setting the total force as zero and solving for $P_W$:

$$P_W = P_S \pm \delta(A_C/A_S) \pm (f_{Coul}/A_S) \quad (4)$$

It can now seen from equation 4 that there are two terms relating to the retarding forces on the displacer which act against movement of the displacer caused by the difference in working volume and spring volume pressure. The second term is a function of the Coulumb friction due to seals or a discrete Coulomb friction braking element. The first term is a function of the pressure differential across the regenerative matrix and the areas of the main body of the displacer and of the drive piston.

The ratio $A_C/A_S$ is always greater than one and can be selected by setting the diameters of the driven piston and main body of the displacer. Thus, to provide increased retarding force to the displacer for proper timing of the displacer relative to the compressor crankshaft angle, the differential pressure term of equation (4) can be increased. In fact, that term can be increased to the extent necessary to account for the entire retarding force needed, and the Coulomb friction term can be decreased to zero. In decreasing the Coulomb friction term to zero, friction seals can be entirely eliminated.

It has been demonstrated that the areas and pressures included in the above equations can be set such that the displacer and drive piston generally move in proper synchronization with the compressor pressure wave for most efficient cooling. However, through time, various mechanical changes in the system, including changes in friction, leakage past the compressor piston, leakage past the drive piston clearance seal and the like can result in change in the phase of the displacer movement relative to the pressure wave. Further, with virtually dragless clearance seals, stopping the displacer/piston at the end of each stroke prior to rapping against the end of the cold finger can become a problem. Where friction seals are still used, friction of those seals can change with changes in temperature and the like and result in the displacer making less than a full stroke with each cycle.

The linear motor provided in FIG. 5 is for the purpose of merely trimming the motion of the displacer to assure that the displacer makes full strokes without rapping the ends of the cold finger in proper phase with the pressure wave. Because the motor merely provides fine tuning of the displacer movement, primarily at the ends of each stroke, a large linear motor is not required. The power requirements of the motor, for a one quarter watt Stirling refrigerator, can be less than one third the power requirements in such a refrigerator in which the linear motor must provide the primary driving force to drive the displacer through its entire stroke. The housing for the motor can thus be only a little larger than what is generally required for the spring volume of a refrigerator having no linear motor.

Figure 6:
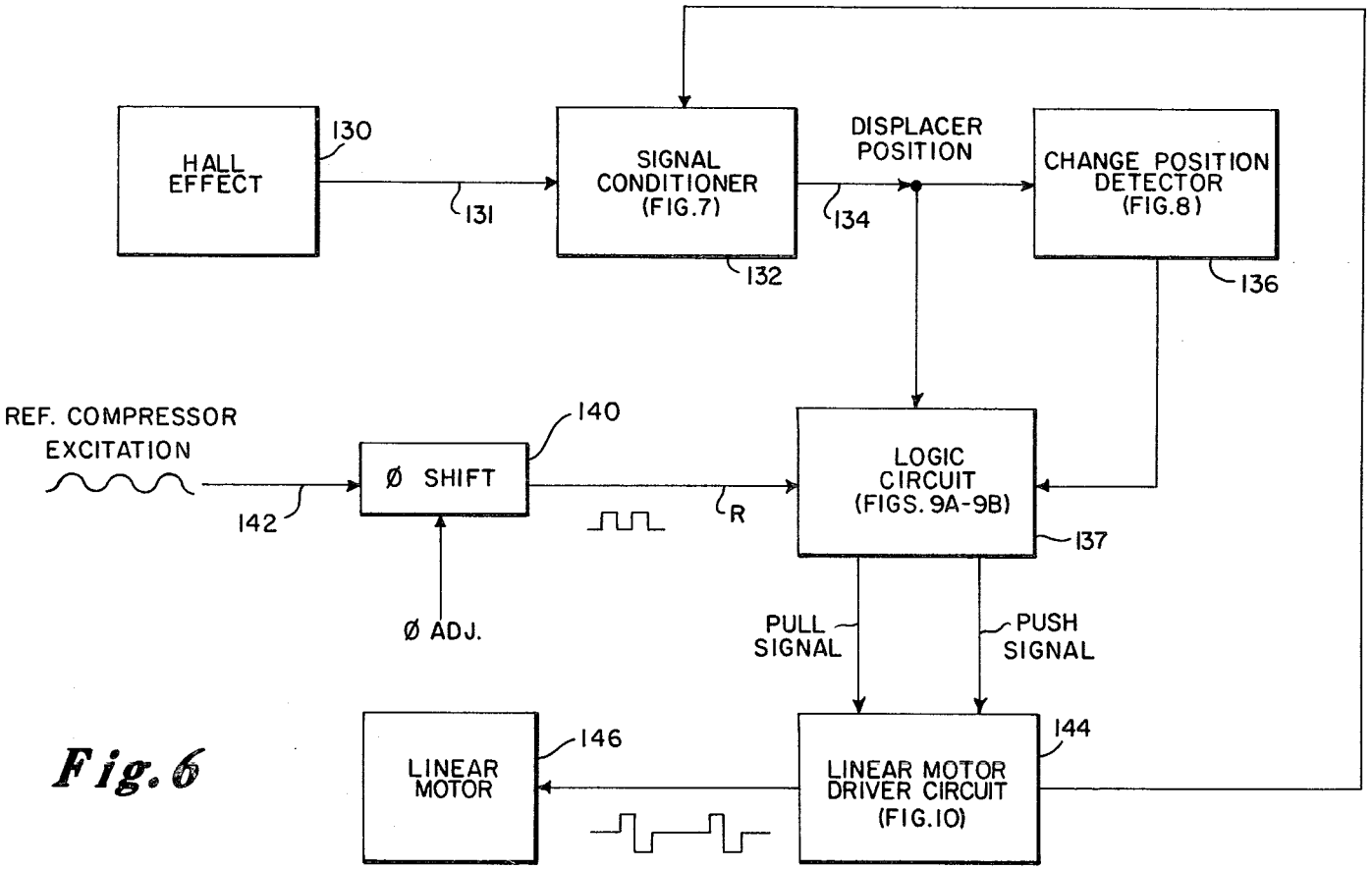
FIG. 6 is a block diagram of the electronic control of the linear drive motor to the displacer in the system of FIG. 5.

The particular circuitry presently used to drive the linear motor of FIG. 5 is shown in FIGS. 6–10. FIG. 6 is a block diagram of the overall circuitry. The signal from the Hall effect sensing element 128 is processed in a conventional Hall effect circuit 130. The Hall effect device senses the position of the magnetic armature 118 of the linear motor. However, the signal from the Hall effect device is also responsive to the magnetic flux set up by the stator coils of the motor. A signal conditioner 132 removes that portion of the Hall effect signal resulting from the coil flux to provide a true armature position signal on line 134. That signal is further processed in a changing position detector 136 to provide signals which indicate whether the displacer is moving and in which direction it is moving. The direction signals are applied along with the position signal to logic circuit 137.

The logic circuit also receives a signal R representative of the timing of the pressure wave. By adjusting the phase shift of a compressor excitation signal 142 through a phase shift circuit 140, the desired phasing of the displacer movement relative to compressor wave can be established. The logic circuit 137 provides either a push signal or a pull signal to a linear motor drive circuit 144. When a push signal is received, the driver circuit energizes the two coils 110 and 112 of the linear motor 146 to push the displacer toward the cold end of the cold finger. When a pull signal is received, the driver circuit drives current through the two coils to pull the displacer back towards the warm end.

Figure 7:
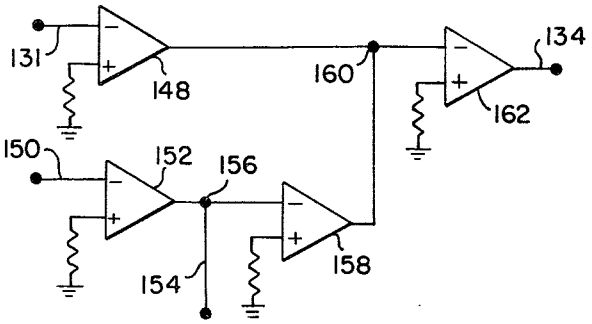
FIG. 7 is an electrical schematic drawing of the signal conditioner of FIG. 6.

The signal conditioner 132 is shown in FIG. 7. The signal 131 from the Hall effect circuit 130 is amplified in amplifier 148. In addition, a signal 150 from the linear motor driver circuit 144 is applied through an inverting amplifier 152. The signal 150 is indicative of current flow through the motor coils to pull the displacer. A signal 154, indicative of whether push current is applied to the motor coils, is applied to the summing node 156 at the input of an inverting amplifier 158. The output of that amplifier is applied to a summing node 160 which also receives the amplified Hall effect signal. The signal applied to the amplifier 162 is thus the Hall effect signal, compensated for the motor current, to provide a true position signal on line 134.

Figure 8:
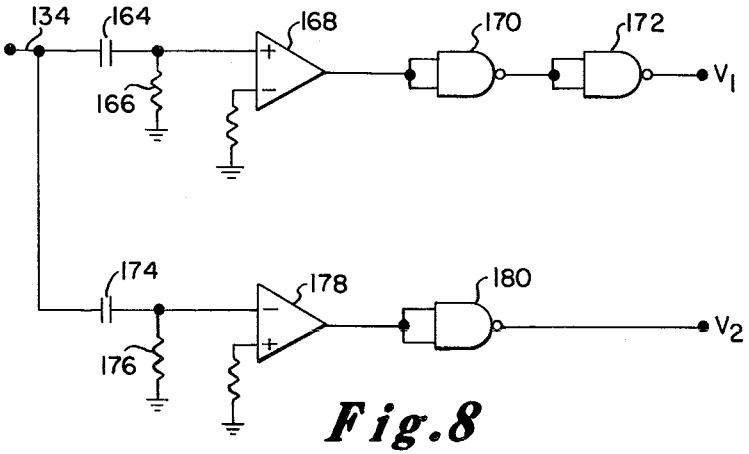
FIG. 8 is an electrical schematic diagram of the changing position detector of FIG. 6.
Figure 10:
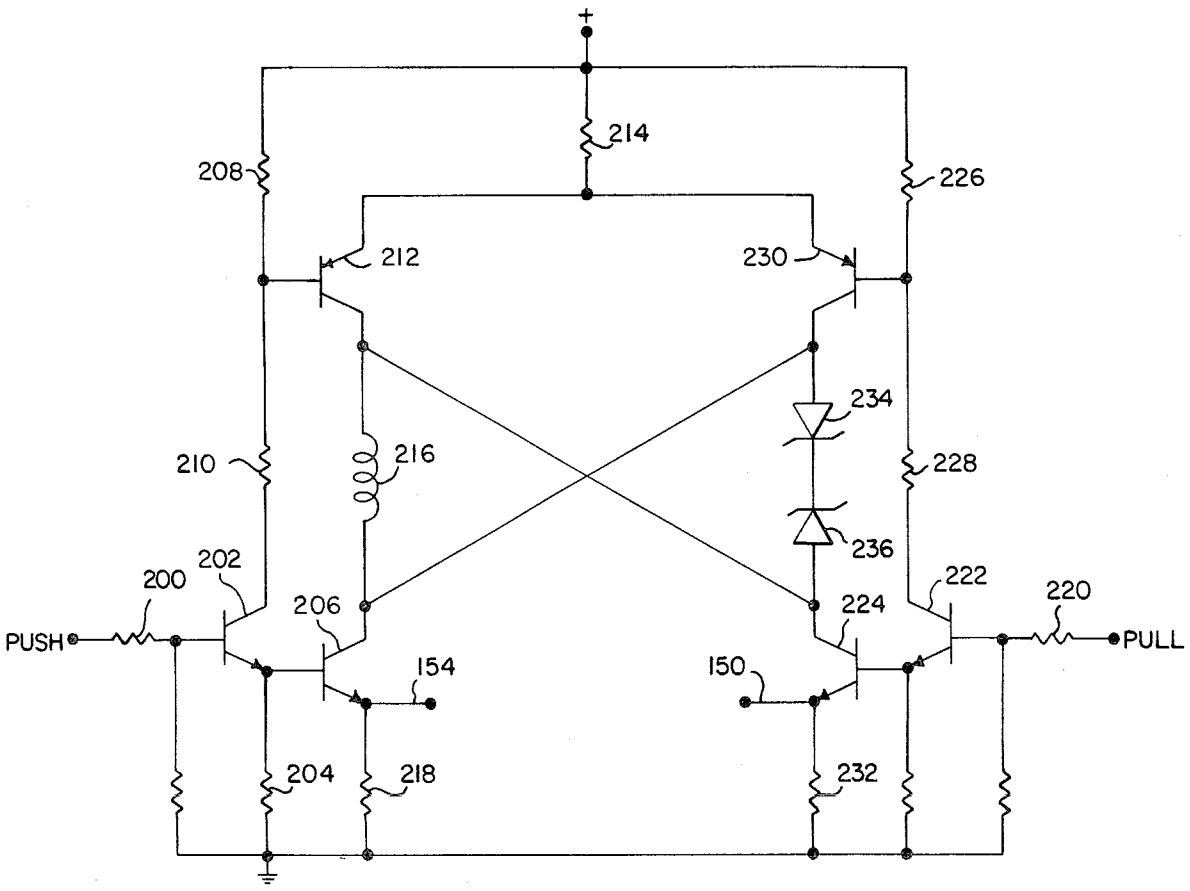
FIG. 10 is an electrical schematic diagram of the linear motor drive circuit of FIG. 6.

The changing position detector is shown in FIG. 8. The position signal on line 134 is applied through a differentiating circuit including capacitor 164 and resistor 166 to an amplifier 168 to provide a signal which indicates when the displacer is moving toward the cold end. That signal is squared by a NAND gate 170 and then reinverted by a NAND gate 172. The position signal 134 is also applied through another differentiating circuit comprising capacitor 174 and resistor 176 to an amplifier 178 which provides an output which indicates when the displacer is moving toward the warm end. That signal is squared by the NAND gate 180.

Figure 9A:
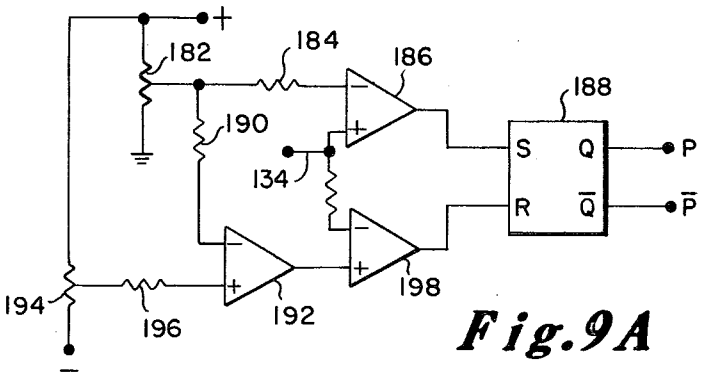
FIGS. 9A and 9B are electrical schematic diagrams of the logic circuit of FIG. 6.
Figure 9B:
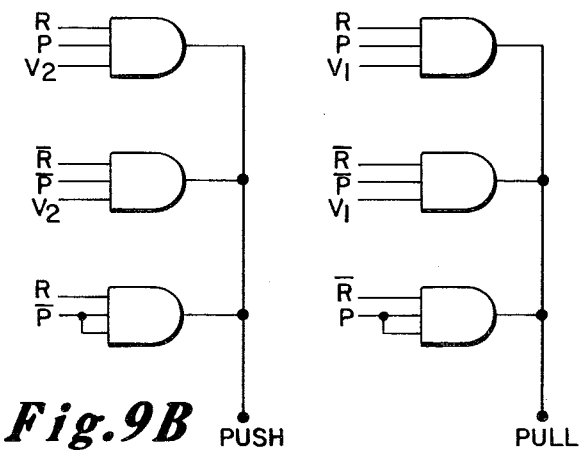

The logic circuitry for controlling the linear motor driver circuit is shown in FIGS. 9A and 9B. In the circuit of FIG. 9A, the position signal 134 is compared to reference signals to establish positions of the displacer at which the displacer is to be considered at the ends of its strokes. The cold end-end stroke position is determined directly by comparing the position signal on line 134 with a signal derived from a potentiometer 182 through a resistor 184. The signals are compared in an amplifier 186. As the displacer reaches the end-stroke position at the cold end, a signal is applied by the amplifier 186 to the set input of a flip flop 188 to provide a high output on line P.

The same signal taken from the potentiometer 182 to determine the cold end end stroke position is applied through a resistor 190 to a comparator 192. The other input to that comparator is taken from a potentiometer 194 through a resistor 196. The potentiometer 194 sets the point of symmetry, that is the midpoint, between the end stroke positions at the two ends of the stroke. The signal from comparator 192 is applied through another comparator 198 in which it is compared with the position signal on line 134. When the position has reached the warm end end stroke position, the flip flop 188 is reset to provide a high output at the P− line to indicate that the displacer has completed its stroke to the warm end.

The end position signals P and P−, the direction of movement signals V1 and V2 and the phase shifted signal R are applied to the AND gates of FIG. 9B to provide push and pull signals.

The reference signal R is timed such that the displacer should be moving toward the cold end or at the cold end so long as that signal is high. When the signal is low, the displacer should be moving toward the warm end or be at the warm end. Thus, if the displacer should be moving toward the cold end but has not reached the cold end (R and P−) a push signal is applied. If the displacer should be moving toward the cold end, has reach the cold end and is continuing toward the cold end (R and P and V1), a pull signal is applied because the displacer is passing its end stroke position. This signal prevents striking of the displacer at the end of the cold finger. If the displacer should be moving toward or be at the cold end, has passed the end stroke position, but is moving back towards the warm end (R and P and V2), as when the displacer has been pulled back after reaching end stroke, a push signal is again applied. Similar push and pull signals are applied under similar conditions at the warm end.

Figures 1, 2, 3, 4:
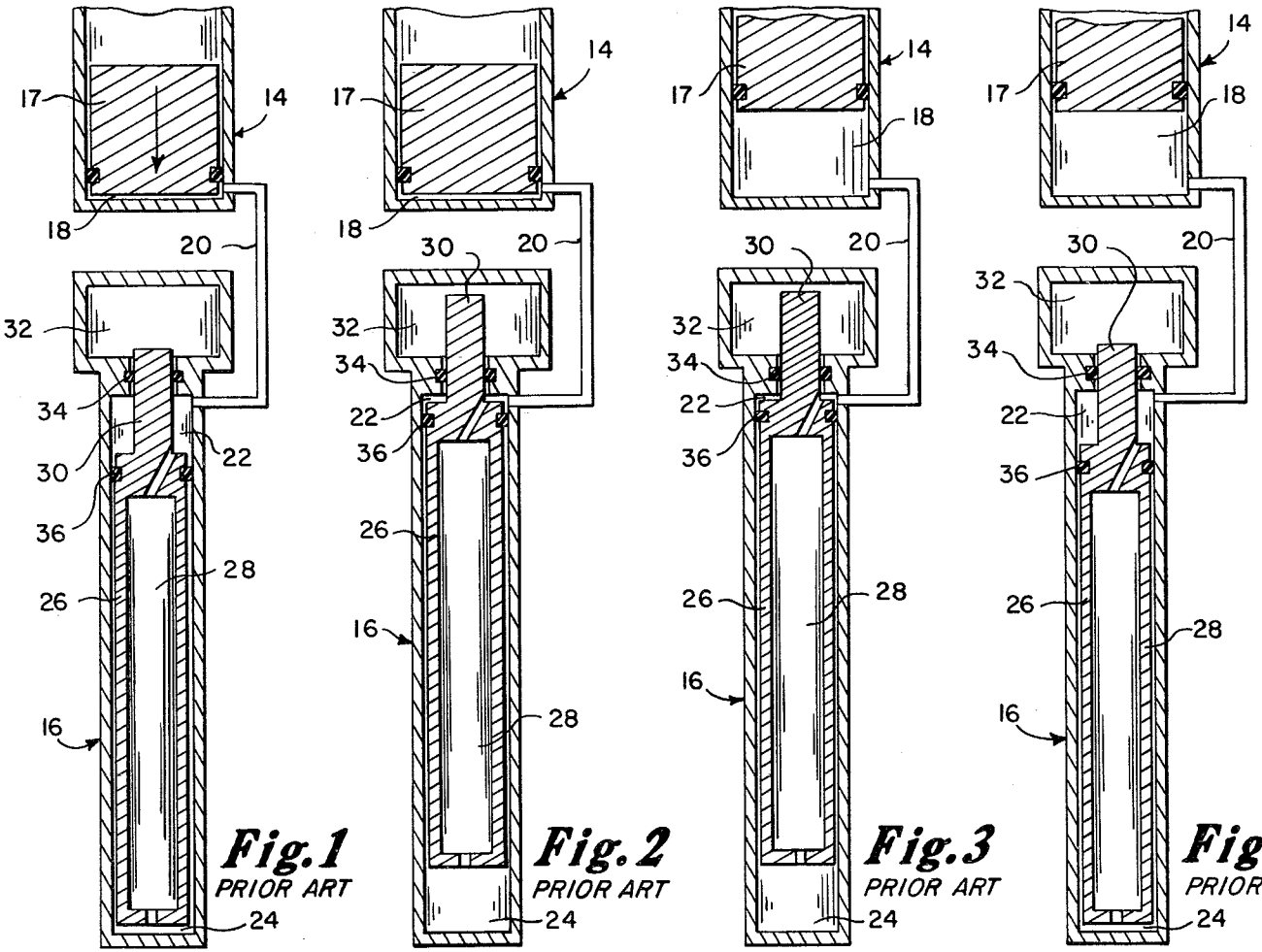
Fig. 4 PRIOR ART
Fig. 3 PRIOR ART
Fig. 2 PRIOR ART
Fig. 1 PRIOR ART
FIGS. 1–4 illustrate operation of a conventional pneumatically driven split Stirling refrigerator.

The motor drive circuit is shown in FIG. 1. The push signal is applied through a resistor 200 to turn on a transistor 202. With transistor 202 driving current through resistor 204, transistor 206 is also turned on. Also, with current being drawn through resistors 208 and 210 transistor 212 is turned on. With the transistors 206 and 212 on, current is drawn through the resistor 214 and the motor coil 216. Current through the coil in this direction pushes the displacer toward the cold end. This current is sensed across the resistor 218 at line 154 and a signal applied to the signal conditioner 132 as discussed above. When the push signal is no longer applied, transistors 202, 206 and 212 are turned off so that no motor current is applied.

When a pull signal is applied across resistor 220, transistor 222 is similarly turned on to turn on transistor 224 and, through resistors 226 and 228, to turn on transistor 230. With transistors 224 and 230 conducting, current is drawn through resistor 214 from transistor 230 and directed to the lower end of the coil 216 as viewed in FIG. 10. The current passes through the coil 216 in the pull direction and is then drawn through the transistor 224. As before, the voltage across the resistor 232 provides the pull signal on line 150 which is applied to the signal conditioner 132. Zener diodes 234 and 236 avoid an overvoltage condition across the coil 216.

While the invention has been particularly shown and described with reference to a preferred embodiment thereof, it will be understood by those skilled in the art that various changes in form and details may be made therein without departing from the spirit and scope of the invention as defined by the appended claims. For example, more sophisticated trimming of the displacer movement can be provided. As an example, the actual speed of movement of the displacer might be controlled. However, it is believed that the most significant aspects of the control, particularly where clearance seals are used so that short stroking is not a problem, are for phase control and prevention of overstroke. Overstroke can be a significant problem as a cause of vibration in infrared sensor systems.

We claim:

1. A refrigerator having a gas displacer which reciprocates in a housing to displace gas in a working volume of gas through a regenerator, the fluid pressure in the working volume varying between maximum and minimum pressures, the refrigerator further comprising:

a spring volume of gas having a fluid pressure intermediate the maximum and minimum pressures in the working volume;

a piston element extending axially from the displacer into the spring volume, the cross sectional areas of the piston element and the displacer being such that the pressure differential across the piston element, between the working volume and the spring volume, drives the displacer through a substantially full stroke, substantially retarded relative to the fluid pressure in the working volume, in each direction; and electrically powered linear motor drive means for driving the displacer in each of two directions to trim the movement of the displacer resulting from the pressure differential across the piston the load handling capability of the linear motor drive means being substantially less than the load of the driven displacer.

2. A refrigerator as claimed in claim 1 comprising sensor means for sensing position of the displacer, wherein the electrically powered linear drive means is responsive to the sensed position.

3. A refrigerator as claimed in claim 2 wherein the electrically powered linear drive means is energized to assure a full stroke of the displacer, to prevent overstroke of the displacer and to assure a proper phase relationship between the displacer and the working fluid pressure waves.

4. A refrigerator as claimed in claim 2 wherein the electrically powered linear drive means is energized in response to the direction of movement signal.

5. A refrigerator as claimed in claim 1 wherein the electrically powered linear drive means is energized to assure full stroke of the displacer.

6. A refrigerator as claimed in claim 1 wherein the electrically powered linear drive means is energized to prevent overstroke of the displacer.

7. A refrigerator as claimed in claim 1 wherein the electrically powered linear drive means is energized to assure proper phasing of the displacer relative to the working fluid pressure wave.

8. A refrigerator as claimed in claim 1, that refrigerator being a split Stirling refrigerator.

9. A refrigerator having a gas displacer which reciprocates in a housing to displace gas in a working volume of gas through a regenerator, the fluid pressure in the working volume varying between maximum and minimum pressures, the refrigerator further comprising:

a spring volume of gas having a fluid pressure intermediate the maximum and minimum pressures in the working volume;

a piston element extending axially from the displacer into the spring volume, the cross sectional area of the piston element being such that the pressure differential across the piston element, between the working volume and the spring volume, drives the displacer element through a substantially full stroke in each direction;

sensor means for sensing the axial position of the displacer; and electrically powered linear drive means responsive to the sensor means for driving the displacer in each of two directions to trim phasing and amplitude of the movement of the displacer resulting from the pressure differential across the piston the load handling capability of the linear drive means being substantially less than the load of the driven displacer.

* * * * *